United States Patent [19]

Hancox

[11] 4,246,632

[45] Jan. 20, 1981

[54] LAMP ASSEMBLY AND METHOD OF MANUFACTURE THEREOF

[75] Inventor: Royston N. Hancox, Conventry, England

[73] Assignee: Lucas Industries Limited, Birmingham, England

[21] Appl. No.: 940,228

[22] Filed: Sep. 7, 1978

[30] Foreign Application Priority Data

Sep. 21, 1977 [GB] United Kingdom ..... 39294/77

[51] Int. Cl.[3] ..... F21V 21/00

[52] U.S. Cl. ..... 362/382; 362/61; 339/17 D; 339/176 L

[58] Field of Search ..... 362/23, 61, 80, 95, 362/226, 227, 249, 382, 455, 456; 339/17 D, 176 L, 127

[56] References Cited

U.S. PATENT DOCUMENTS 3,344,388 9/1967 Parker et al. ..... 339/17 D

FOREIGN PATENT DOCUMENTS 1489614 4/1969 Fed. Rep. of Germany .
1539616 11/1969 Fed. Rep. of Germany ..... 339/176 L
2421422 11/1975 Fed. Rep. of Germany ..... 339/176 L
2441330 3/1976 Fed. Rep. of Germany ..... 362/61
2226618 11/1974 France .
2307222 11/1976 France .

OTHER PUBLICATIONS

U.S.S.R. Inventor's Certificate No. 382,315.
Russian book entitled "Design of Electrical Apparatus", p. 303.

*Primary Examiner*—Joseph W. Hartary
*Assistant Examiner*—Alan Mathews
*Attorney, Agent, or Firm*—Ladas & Parry

[57] ABSTRACT

A lamp assembly, particularly a rear lamp assembly for a motor vehicle has an electrically insulating hollow body, a plurality of bulbholders, and a plurlity of spaced, electrically conductive elements, cut from an electrically conductive sheet, extending between a location in the body at which an electrical supply connector is attached to the assembly in use and respective locations in the body adjacent the bulbholders. At least one bulb contact blade extends into each bulbholder and each bulb contact blade has a substantially U-shaped blade portion which is disposed externally of the bulbholder. Electrically conductive blades are integral with at least some of the electrically conductive elements. Each blade is in facial contact with internal faces of the respective substantially U-shaped blade portion. Each U-shaped blade portion is preferably an interference fit in a respective support integral with a base of the body.

The facial contact between each blade and its respective U-shaped blade portion ensures a good electrical contact therebetween.

5 Claims, 3 Drawing Figures

LAMP ASSEMBLY AND METHOD OF MANUFACTURE THEREOF

This invention relates to a lamp assembly and a method of manufacture thereof.

A lamp assembly is known (see German Auslegeschrift No. 2441330) in which a hollow, electrically insulating body supports a plurality of spaced electrically conductive elements which extend from a location at which an electrical supply connector is connected with the elements in use, to respective bulbholder locations. Holes are formed in one of the conductive elements and separately moulded plastics bulbholders are engaged with a snapfit action into the holes. Portions of the respective electrically conductive elements in the region of the electrical supply location are shaped to provide blade terminals for connection with female terminals in the supply connector. Other portions of the electrically conductive elements are shaped to provide contacts which are electrically connected to respective bulb contact blades carried by the bulbholders. The electrically conductive elements are all formed from the same sheet metal blank by piercing the blank to define the electrically conductive portions but leaving parts of the sheet metal unpierced so that the electrically conductive elements are held in the required relative dispositions by the integral joining parts. Then the portions of the electrically conductive elements which are to form the terminals and the contacts are simply bent out of the plane of the sheet to define the terminals and the contacts. At this stage, the sheet, having previously had the sub-assembly of bulbholders and bulb contacts to be carried thereby snap-fitted thereto, is mounted in a die and the joining parts are then removed whilst maintaining the electrically conductive elements and the bulbholders in the required dispositions. The hollow electrically insulating body is inserted into the die so that spigots on the free ends of supports extending integrally from an internal surface of the base of the body extent through holes in the respective conductor elements. The spigots are subsequently deformed over by a heating tool to retain the conductive elements in position. Finally, a moulding including a bulb reflector is fixed in position on the body on the opposite side of the electrically conductive elements to the base of the body and a composite lens element is fitted over said bulb reflector moulding to complete the lamp assembly.

In the above construction, the portions of the electrically conductive elements to be engaged by parts of the bulb contact blades are bent out of the general plane of the elements to define contact blades which engage in portions of the bulb contact blades which project externally of the bulbholders. Each of these portions of the bulb contact blades is produced by bending an end portion of the blade back on itself to double the thickness of the blade and cutting a slot in the doubled-over portion. The slot has a width which is marginally less than the thickness of the sheet from which the elements and the contact blades integral therewith are formed. The contact blades integral with the elements are engaged in the respective slots so that the plane of each contact blade is at right angles to the plane of the respective slotted portion of the bulb contact blade. This construction only gives a limited contact area which can result in electrical supply problems such as undue electrical resistance at the contact area.

An object of the present invention is to obviate or mitigate such problems by improving the electrical contact.

According to one aspect of the present invention there is provided a lamp assembly comprising an electrically insulating hollow body, a plurality of bulbholders, a plurality of spaced, electrically conductive elements, cut from an electrically conductive sheet, extending between a location in the body at which an electrical supply connector is attached to the assembly in use and respective locations in the body adjacent the bulbholders, at least one bulb contact blade extending into each bulbholder, each bulb contact blade having a substantially U-shaped blade portion disposed externally of the bulbholder, and blade portions integral with at least some of the electrically conductive elements, each said blade portion being in facial contact with internal faces of the respective substantially U-shaped blade portion.

Preferably each U-shaped portion is mounted in a hollow support.

Conveniently each U-shaped portion is an interference fit in the support and may be barbed to oppose withdrawal from the support.

Preferably also, the hollow support is integral with a base of the body.

The above form of construction ensures large areas of contact between the blade portions and the respective bulb contact blades.

According to another aspect of the present invention, there is provided a method of manufacturing a lamp assembly as defined in any one of the last preceding four paragraphs but one, said method comprising the steps (some of which are not necessarily in the order given) of:

(1) forming said electrically conductive elements by cutting a sheet of electrically conductive material whilst leaving integral joining pieces whereby the elements are temporarily held in the required relative dispositions;
(2) forming said blade portions integral with at least some of the electrically conductive elements;
(3) supporting the sheet in which the electrically conductive elements have been formed;
(4) removing the integral joining pieces during step (3) so that the elements are maintained in said required relative dispositions;
(5) assembling the bulb contact blades into the bulbholders;
(6) bringing the hollow body and the supported electrically conductive elements from step (4) into engagement; and
(7) securing the body and the elements together with the blade portions of the elements in facial contact with the U-shaped blade portions of the respective bulb contact blades.

An embodiment of the present invention will now be described, by way of example, with reference to the accompanying drawings, in which.

Figure 1:
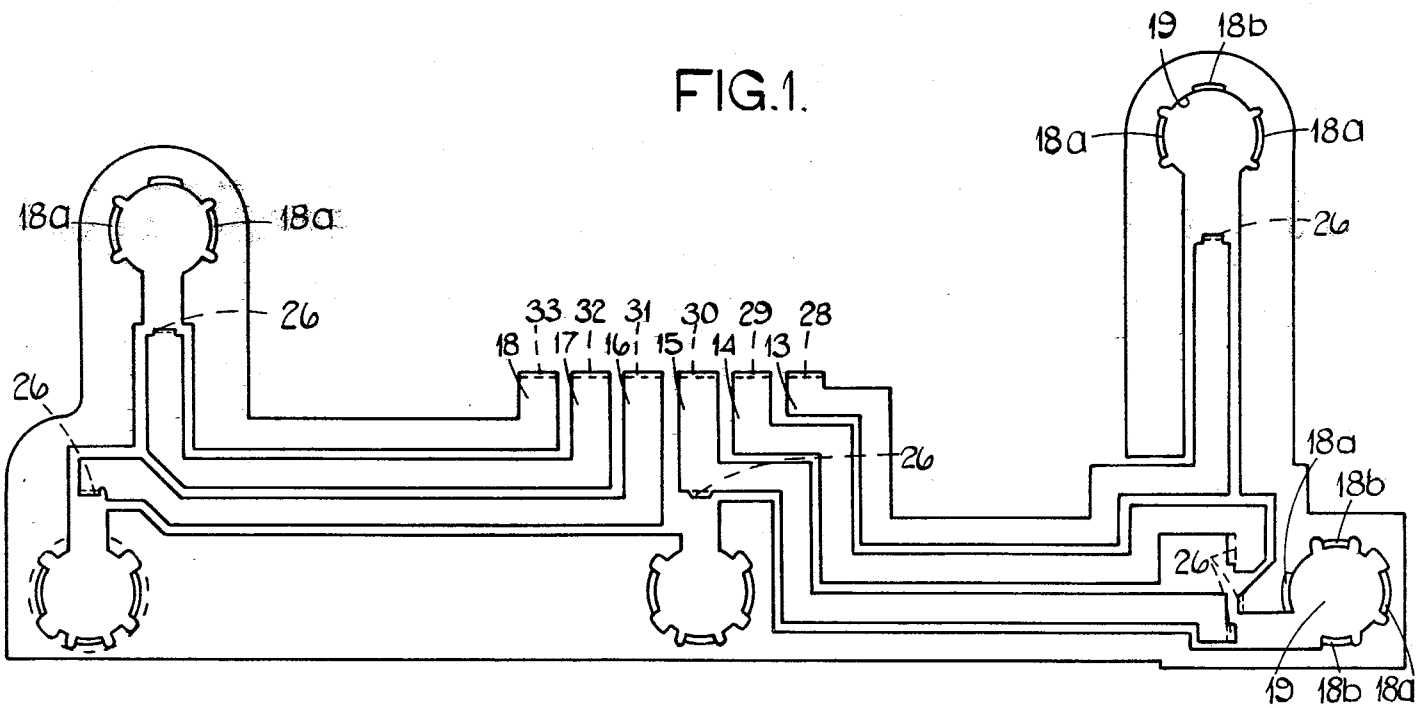
FIG. 1 is a plan view of electrically conductive elements in the relative dispositions in which they appear in a lamp assembly according to one example of the present invention.
Figure 2:
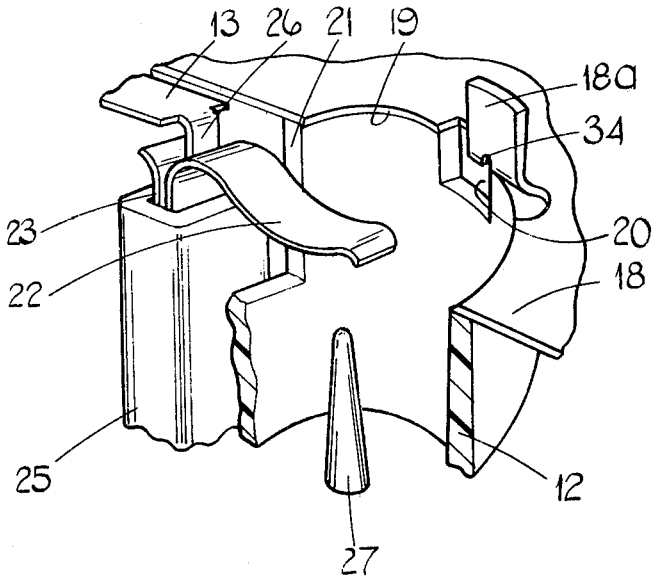
FIG. 2 is a perspective view of part of the lamp assembly showing a portion of the electrically conductive elements in the region of a bulbholder.
Figure 3:
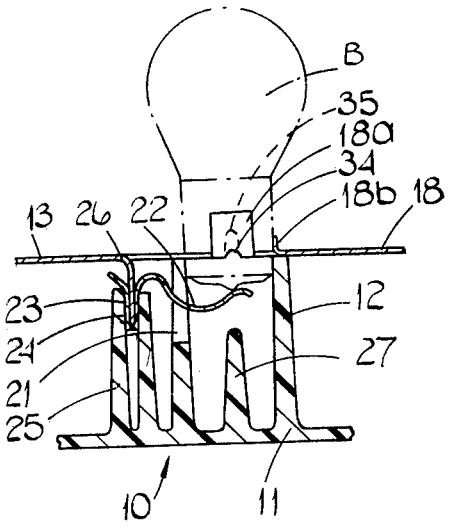
FIG. 3 is a sectional view of one of the bulbholders.

Referring to the drawings, the lamp assembly comprises an electrically insulating, hollow moulded plastics body 10 (only partially shown in the drawings) which is of generally dished form having a rectangular base 11 with upstanding peripheral wall (not shown). Integrally moulded with the body 10 are a plurality of, in this embodiment, five tubular elements 12 which are disposed internally of the body 10 and which extend upwardly from the base 11. Extending over the otherwise open end face of the body 10 are a plurality of electrically conductive elements 13 to 18 all formed from the same mild steel sheet in a manner to be described hereinafter. The element 18 forms an earth return for each of five bulbholders defined partly by the respective tubular elements 12 and partly by upturned portions 18*a*, 18*b* of the element 18. Such upturned portions 18*a* and 18*b* are disposed around respective circular holes 19 provided in the element 18 in alignment with the respective tubular elements 12. The internal surface at the top end portion of each tubular element 12 has a pair of diametrically opposed recesses 20 therein (only one shown—see FIG. 2) and these recesses 20 co-operate with respective upturned portions 18*a* together to define bayonet connections for bulbs B (as shown in dotted line in FIG. 3). Each tubular element 12 has a cut-out 21 therein through which passes a resilient bulb contact blade 22 for engaging against a centre contact of the bulb. In fact, in the embodiment illustrated, the bottom right-hand bulb holder as viewed in FIG. 1 is provided with two such blades 22 for engagement with two centre contacts in a bulb having two filaments.

Each bulb contact blade 22 extends externally of the respective tubular element 12 to terminate in a U-shaped portion 23 provided with a barb 24. Each U-shaped portion 23 is an interference fit in a hollow support post 25 extending integrally from the base 11 adjacent the respective tubular element 12. The barb 24 prevents accidental withdrawal of the U-shaped portion 23 from the respective post 25. A blade contact 26 integral with each electrically conductive element 13 to 18 engages between the arms of each U-shaped portion 23 so as to be in facial contact with the internal faces of the U-shaped portion 23 whereby a substantial contact area is afforded between each contact 26 and its respective bulb contact blade 22. As will be apparent from the drawings, each blade contact 26 is planar and is un-apertured and is not provided with any barbs thereon whereby a substantial surface area of contact is ensured. Each bulb contact blade 22 is of a substantially larger width than the respective blade contact 26 so as to ensure engagement therebetween within the allowable tolerances of manufacture. In order to assist in engagement, the entry to each U-shaped portion 23 is flared so as to provide a lead-in for the respective blade contact 26. Once engaged in the respective U-shaped portion 23, each blade contact 26 also serves to urge the U-shaped portion 23 further into engagement with the respective support post 25 so as to further oppose disengagement of the blade 22 from the post 25. The body 10 is provided with a plurality of integral supports which also extend from the base 11 to the underside of the electrically conductive elements 13 to 18 so that the latter rests thereagainst. The electrically conductive elements 13 to 18 have apertures therein through which pass spigots extending integrally and upwardly from the aforementioned supports, said spigots, being heat deformed over so as to secure the elements 13 to 18, to the body. Within each tubular element 12 is provided an upstanding stop 27 to prevent any deformation of the respective contact blade 22 beyond its resilient limit.

Although it is not shown in the drawings, the above-described lamp assembly is also provided with a plastics moulding which has been vacuum aliminized to provide five reflectors thereon. This moulding is provided with apertures at the rear of the respective reflectors to accommodate the bulbs B and also provided with a surrounding rim which engages with the peripheral wall of the body 10 to locate the two parts in the required mutual disposition. Screws (not shown) serve to secure the body and moulding together. Additionally, the lamp assembly is also provided with a composite lens element (also not shown) which overlies the reflectors and is formed of a number of parts of different colours. The body 10 has an opening (not shown) in the base 11 serving to expose blade terminals 23 to 33 formed integrally with the electrically conductive elements 13 to 18.

During manufacture of the lamp assembly as described above, the electrically conductive elements 13 to 18 are, as mentioned above, formed from a single sheet of mild steel. The sheet is subjected to a cutting operation (e.g. piercing) to define the elements 13 to 18 but to leave them interconnected by integral joining pieces so that the elements 13 to 18 are maintained in the desired relationship without being separated from one another. Then, the pierced sheet is subjected to a forming operation which deforms the appropriate portions of the elements 13 to 18 to define the blade terminals 28 to 33 the male contacts 26, and the upturned portions 18*a* and 18*b*. This assembly is then inserted into a die which holds the elements 13 to 18 in the required mutual dispositions. Following this, the pieces joining the electrically conductive elements 13 to 18 together are cut-out whilst retaining the elements 13 to 18 in the desired dispositions within the die. The body 10, with the bulb contact blades 22 assembled into the tubular elements 12 is then placed in the die so that the previously described spigots thereon pass through the respective holes in the elements 13, to 18. During this time, the male contacts 26 have engaged between the limbs of the respective U-shaped portions 23 so that the elements 13 to 18 and the body 10 are temporarily held in position. Following this, the assembly of the body 10 and elements 13 to 18 is removed from the die and a heat deforming operation is performed upon the portions of the spigots projecting above the elements 13 to 18 so as to secure the elements 13 to 18 firmly against the integral supports therefor extending from the base 11. Following this, the reflector moulding is secured to the body 10 and the bulb B can then be inserted into the respective bulbholders before the lens element is finally fitted. It will be appreciated that the upturned portions 18*a* and 18*b* serve not only to provide the necessary electrical contact with the body of the bulbs B but also serve to hold the bulbs B against unwanted tilting during use. It will be appreciated that the pins of the bulbs will engage in bayonet fashion in the recesses 20 to be urged into respective recesses 34 in the upturned portions 18*a* by the respective contact blades 22. In the case of the bulb holder for a bulb having two centre contacts to ensure that the twin filament bulb is inserted in the correct angular disposition in the bulb holder, it is usual practice for the bayonet pins of such a bulb to be displaced relative to one another relative to the axis of the bulb. In such an event, the recess 34 in the appropriate upturned portion 18*a* will be extending upwardly as shown by dotted line 35 in FIG. 3 to accommodate for such axial displacement of the two pins.

The tubular elements 12 may project through the holes 19 in the electrically conductive element 18 in order to provide a further support for the bulb B. It is also possible, instead of the electrically conductive elements 13 to 18 being substantially planar, for them to be stepped at one or more locations in the lamp assembly so as to permit one or some of the bulbholders to be disposed at a different level or levels to the other bulbholders. This is particularly useful since the styling of such a lamp assembly may dictate such a construction.

The above described lamp assembly is intended for mounting at the rear of a vehicle for providing, inter alia, stop, reverse, rear fog lamp, tail and direction indication light facilities. However, it is within the scope of the present invention to provide a lamp assembly of the above described type for uses other than motor vehicles. Attention is drawn to our co-pending British patent application No. 39,295/77 filed on Sept. 21, 1977 and entitled "Lamp Assembly and method of Manufacturing thereof" which specifically relates to the bulbholder construction as described herein.

I claim:

1. A lamp assembly comprising an electrically insulating hollow body, a plurality of bulbholders, a plurality of spaced, electrically conductive elements, cut from an electrically conductive sheet, extending between a location in the body at which an electrical supply connector is attached to the assembly in use and respective locations in the body adjacent the bulbholders, at least one bulb contact blade extending into each bulbholder, each bulb contact blade having a substantially U-shaped portion disposed externally of the bulbholder, and blade portions which are integral with at least some of the electrically conductive elements and each of which is in facial contact with the internal faces of the respective substantially U-shaped portion.

2. A lamp assembly as claimed in claim 1, wherein each U-shaped portion is mounted in a hollow support.

3. A lamp assembly as claimed in claim 2, wherein each U-shaped portion is an interference fit in the support and may be barbed to oppose withdrawal from the support.

4. A lamp assembly as claimed in claim 2 or 3 wherein the hollow support is integral with the base of the body.

5. A method of manufacturing a lamp assembly comprising the steps (some of which are not necessarily in the order given) of:

(1) providing an electrically insulating hollow body which defines at least partly each of a plurality of bulbholders;

(2) providing a plurality of bulb contact blades each having a substantially U-shaped portion;

(3) cutting a sheet of electrically conductive material so as to form a plurality of spaced electrically conductive elements joined together by integral joining pieces whereby the elements are temporarily held in predetermined relative dispositions;

(4) forming blade portions integral with at least some of the electrically conductive elements;

(5) supporting the sheet in which the electrically conductive elements have been formed;

(6) removing the integral joining pieces during step (5) so that the elements are maintained in said predetermined relative dispositions;

(7) mounting said bulb contact blades to said hollow body so that at least one bulb contact blade extends into each bulbholder with the substantially U-shaped portion disposed externally of the bulbholder;

(8) bringing the hollow body and the supported electrically conductive elements from step (6) into engagement; and (9) securing the body and the elements together with the blade portions of the elements in facial contact with the internal faces of the substantially U-shaped portions of respective bulb contact blades.

* * * * *